US007481677B1

(12) United States Patent
Yi et al.

(10) Patent No.: US 7,481,677 B1
(45) Date of Patent: Jan. 27, 2009

(54) ELECTRICAL CONNECTOR WITH ELECTROSTATIC DISCHARGE PROTECTION

(75) Inventors: Chong Yi, Mechanicsburg, PA (US); Joseph Ortega, Camp Hill, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/978,870

(22) Filed: Oct. 30, 2007

(51) Int. Cl.
*H01R 13/648* (2006.01)

(52) U.S. Cl. ..... 439/607; 439/541.5

(58) Field of Classification Search ..... 439/608, 439/607, 541.5, 924.1
See application file for complete search history.

(56) References Cited

U.S. PATENT DOCUMENTS 5,947,773 A 9/1999 Karam
6,210,224 B1 * 4/2001 Wu ..... 439/607
6,315,609 B1 11/2001 Chung
6,652,317 B2 * 11/2003 Shao ..... 439/607
6,736,672 B1 * 5/2004 Tsai ..... 439/541.5
7,232,346 B2 * 6/2007 Hu et al. ..... 439/660
7,273,397 B2 * 9/2007 Watanabe et al. ..... 439/607
7,364,463 B1 * 4/2008 Ju ..... 439/607
2008/0119071 A1 * 5/2008 Ting et al. ..... 439/78

* cited by examiner

*Primary Examiner*—Hae Moon Hyeon
(74) *Attorney, Agent, or Firm*—Wei Te Chung

(57) ABSTRACT

An electrical connector has an insulative housing (10) and a number of electrical contacts (20). The insulative housing has a tongue (14, 15) defining a front face (145) and an upper side and a lower side perpendicular to the front face. The electrical contacts include a number of upper contacts (21) and lower contacts (22). The lower contacts are arranged on the lower side of the tongue and each including a contact section. The upper contacts each includes an extending section (212) arranged on the upper side of the tongue. A contact section (215) is bending from a side edge of the extending section of the upper contact and extending through a passageway (147) of the tongue for arranging on the lower side and avoiding the upper contacts shorting to a metal shell of a mating plug.

15 Claims, 6 Drawing Sheets

ELECTRICAL CONNECTOR WITH ELECTROSTATIC DISCHARGE PROTECTION

BACKGROUND OF THE INVENTION

1. Field of the Invention

The present invention relates generally to electrical connector, and more particularly to a connector having improved electrical contacts.

2. Description of Related Art

Electrical connectors are typically used to couple PCB (Printed Circuit Board) which have numerous electrical devices. Some electrical connectors have a mating end wherein conductive terminals are exposed for engagement with the terminals of a mating connector. When mating the connectors, opposite charges at the connector interface may result in an an electrostatic discharge (ESD) between the two connectors. In fact, electrostatic discharges can be generated simply by a person approaching or touching the connector interface or touching the terminal contacts. As known, when the ambient relative humidity drops to fifty percent or below, the human body accumulates a large electrical charge which can be in excess of 20,000 volts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. But sometimes, the electrostatic discharge also happens to the signal contacts. Please refer to FIG. 6, which discloses an electrical connector 300 having J-shaped contacts 60 and a portion 61 thereof is exposed at the front area of the connector 300. A mating plug 200 could touch the portion 61 of the contacts 60 during mating. There is a potential for the high speed contacts 60 thereof to short with the shell 40 of the mating plug 200 which could also result in ESD problem.

Hence, it is desired to provide an electrical connector to overcome the problems mentioned above.

BRIEF SUMMARY OF THE INVENTION

Accordingly, an object of the present invention is to provide an electrical connector having improved electrical contacts for ESD protection.

In order to obtain the object, an electrical connector for mating with a complementary plug comprises an insulative housing and a plurality of electrical contacts attached thereto. The insulative housing has a rear section and a tongue extending from the rear section. The tongue defines a front face at a front end thereof. The tongue also comprises an upper side and a lower side perpendicular to the front face. The electrical contacts include a plurality of upper contacts and a plurality of lower contacts. The lower contacts are arranged on the lower side of the tongue and each including a contact section for contact with the plug. The upper contacts each includes an extending section arranged on the upper side of the tongue. A contact section is bending from a side edge of the extending section of the upper contact and extending through a passageway of the tongue to be arranged on the lower side of the tongue.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
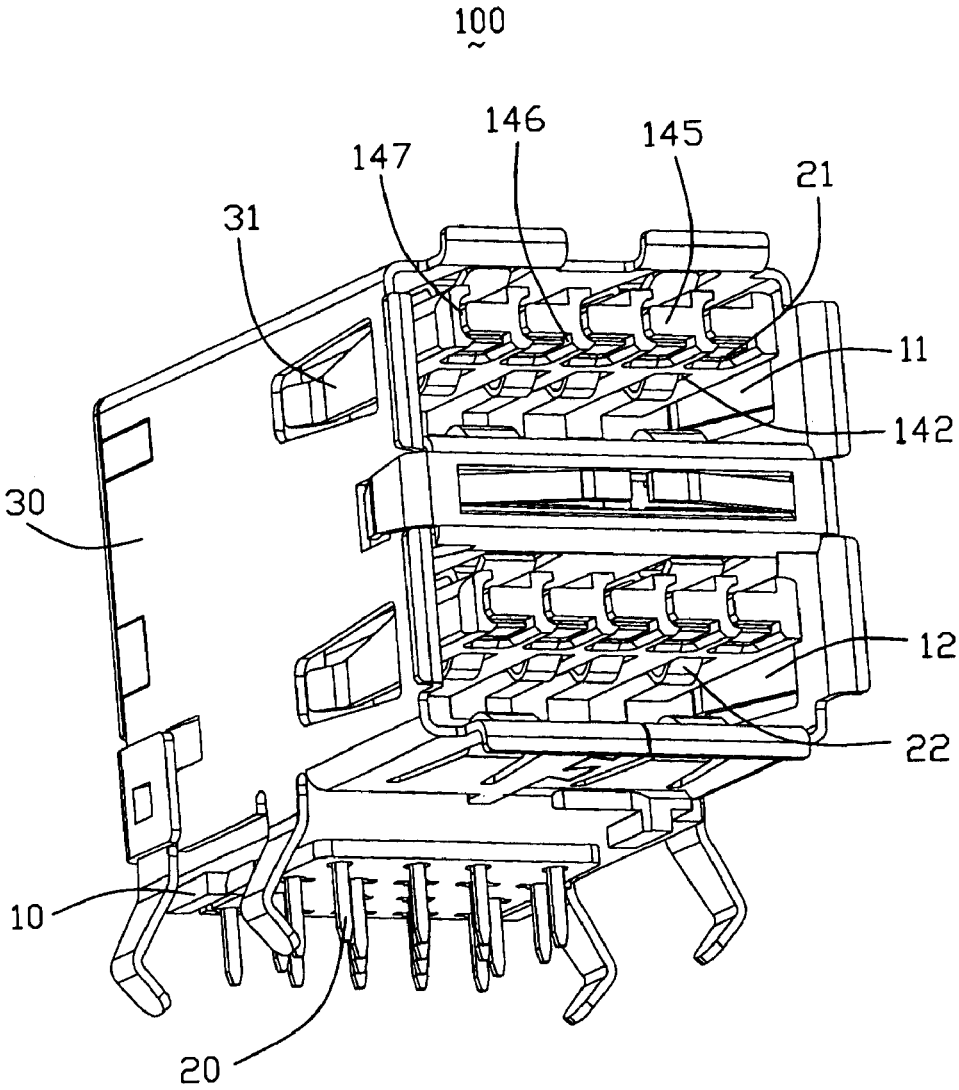
FIG. 1 is a perspective view of an electrical connector according to the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 5:
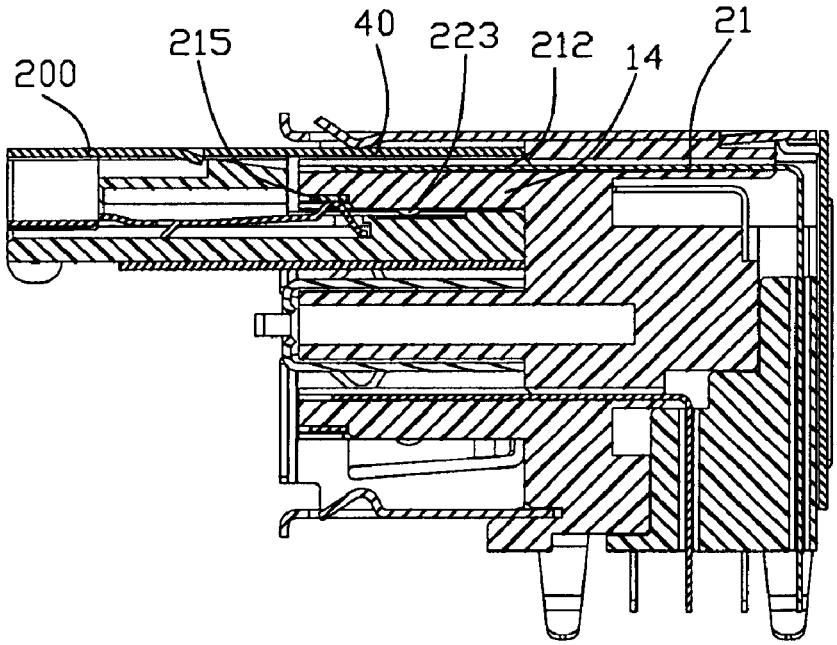
FIG. 5 is a cross sectional view of the electrical connector shown in FIG. 1, wherein an mating plug is inserted therein.
Figure 6:
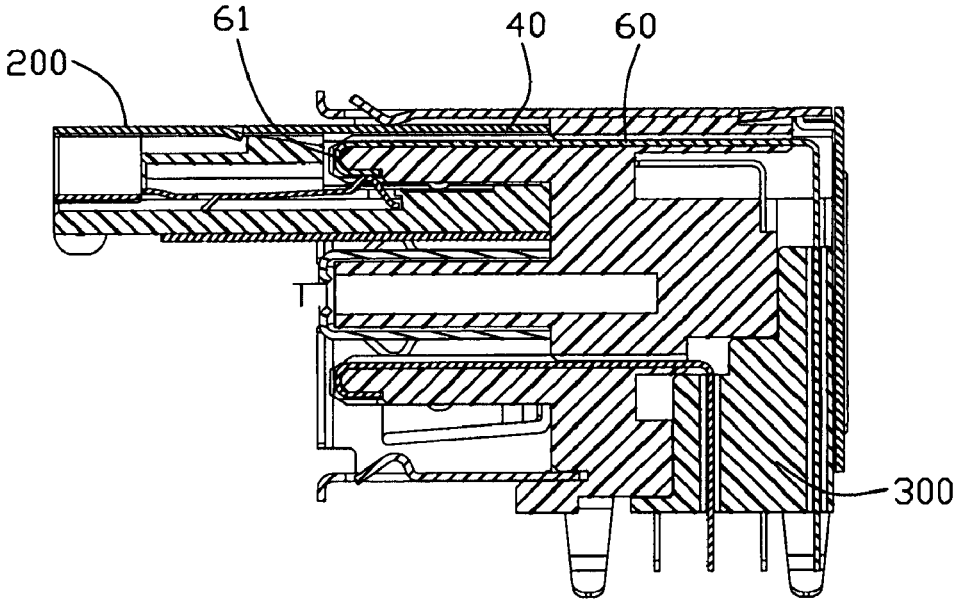
FIG. 6 (PRIOR ART)
FIG. 6 is a cross sectional view of a related art with a mating plug inserted therein.

Referring to FIG. 1, the present invention is directed to an electrical connector 100 mounting to a PCB or motherboard having an insulative housing 10 including a plurality of receiving spaces or receptacle openings 11, 12 each adapted to receive a complementary electrical plug 200 as shown in FIG. 5. The connector 100 includes a plurality of electrical contacts 20 arranged in the first and second groups corresponding to a respective one of the receptacle openings 11, 12. The connector 100 has an outer shield 30 that generally surrounds the housing 10 and has grounding contacts 31 to create an electrical connection between the conductive outer shield 30 and the plug 200 when inserted therein.

While the drawings display a dual stacked connector system 100, the present invention could be used with any type of electrical connector. While each receptacle is shown with nine contacts 20 in a group, the invention can be employed with any desired number of contacts 20 in a group. Similarly, while two receptacles 11, 12 are shown, the invention can be employed with a single receptacle or any desired number of stacked receptacles.

Figure 2:
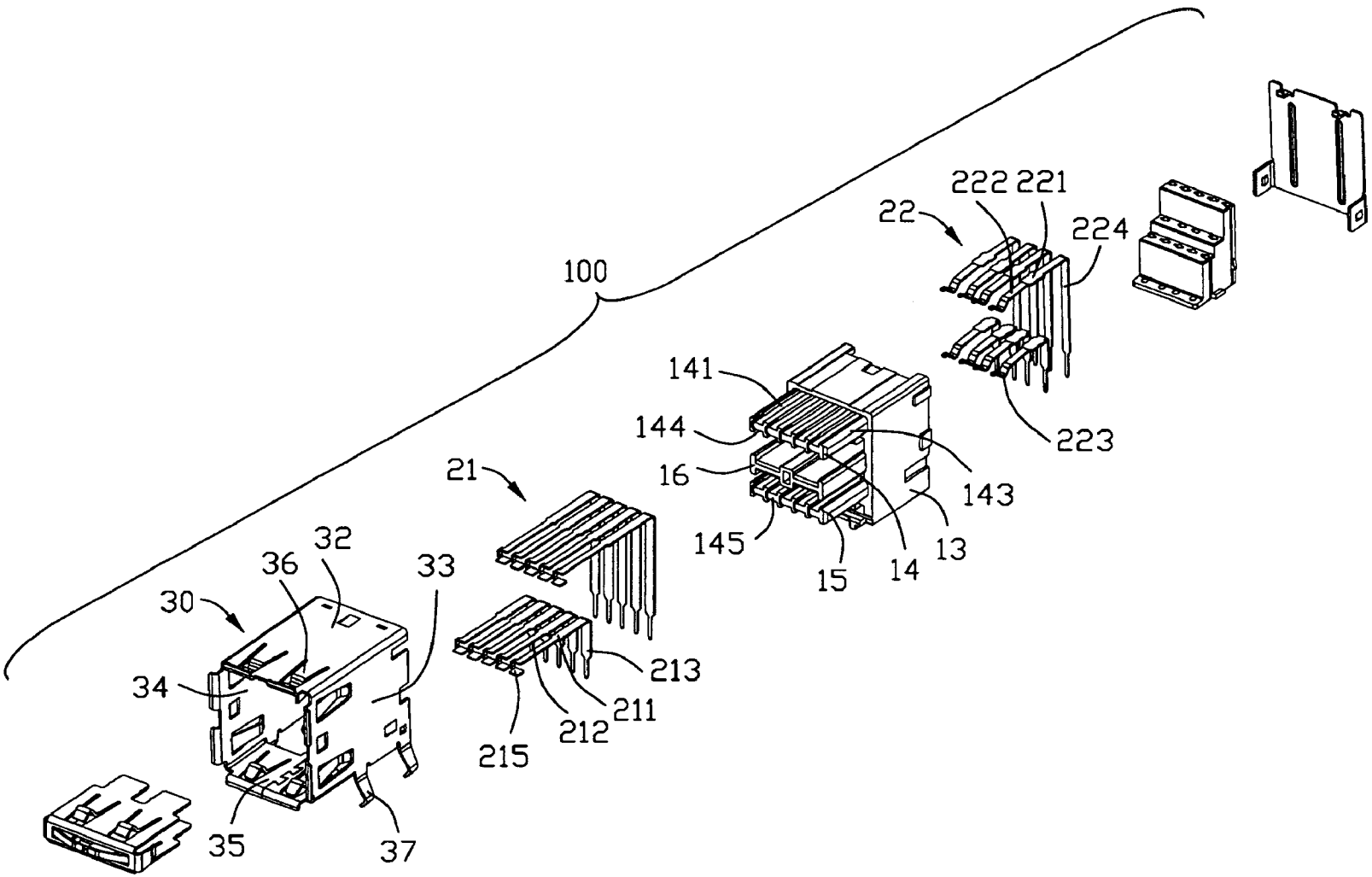
FIG. 2 is an exploded view of the electrical connector shown in FIG. 1.

Referring to FIGS. 1 and 2, the shield 30 is preferably stamped from a single sheet of suitable conductive material, which includes a top wall 32, opposed lateral walls 33, 34, and a bottom wall 35. The opposed top and bottom walls 32, 35 each have longitudinal springs 36 bent so as to extend into the receptacles 11, 12 to bear against a corresponding shield 40 of the plug 200. Board locks 37 mate with the PCB and aid in positioning the electrical connector 100 with respect to the PCB.

Figure 4:
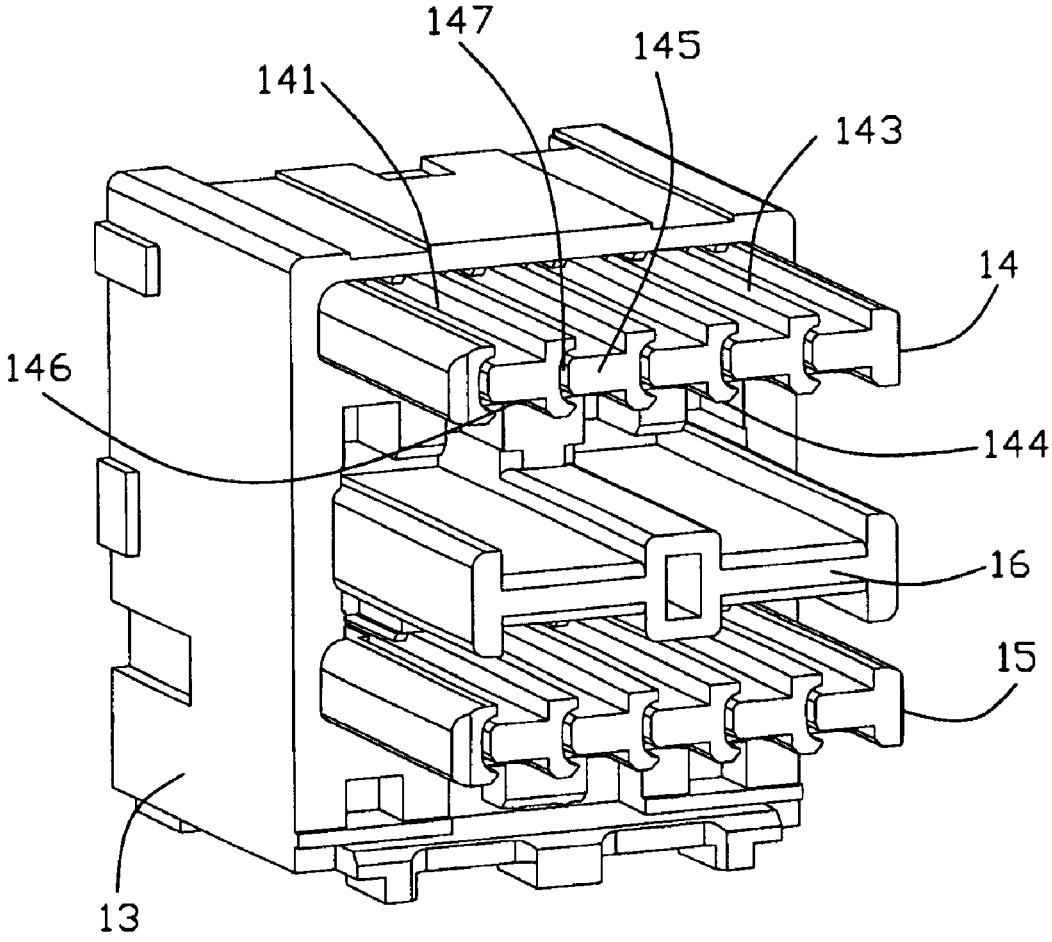
FIG. 4 is a perspective view of the insulative housing shown in FIG. 1.

As illustrated in FIGS. 1, 2 and 4, the insulative housing 10 has a rear section 13 with tongues 14, 15 extending forwardly therefrom. The upper and lower tongue 14, 15 carry the contacts 20. The contacts 20 may be signal contacts, power contacts, or ground contact in various combinations as desired in accordance with a particular application. Each tongue 14, 15 defines two rows of recesses 141, 142 at upper and lower sides 143, 144 thereof. Upper recesses 141 are extending to a mating face or front face 145 of the tongue 14, 15 and the front face 145 are perpendicular to the upper and lower sides of the tongue 14, 15. The tongue 14, 15 also defines a row of notches 146 at the lower side 144 and located between the lower recesses 142 and the front face 145 along the mating direction of the electrical connector 100. A plurality of passageways 147 extend from the side edges of the upper recesses 141 and through the tongue 14, 15 for communicating with the lower notches 146 and the upper recesses 141. The passageways 147 are perpendicular to the front face 145. Also as illustrated, a middle flange 16 extends from the housing 10 to separate receptacle openings 11, 12.

Figure 3:
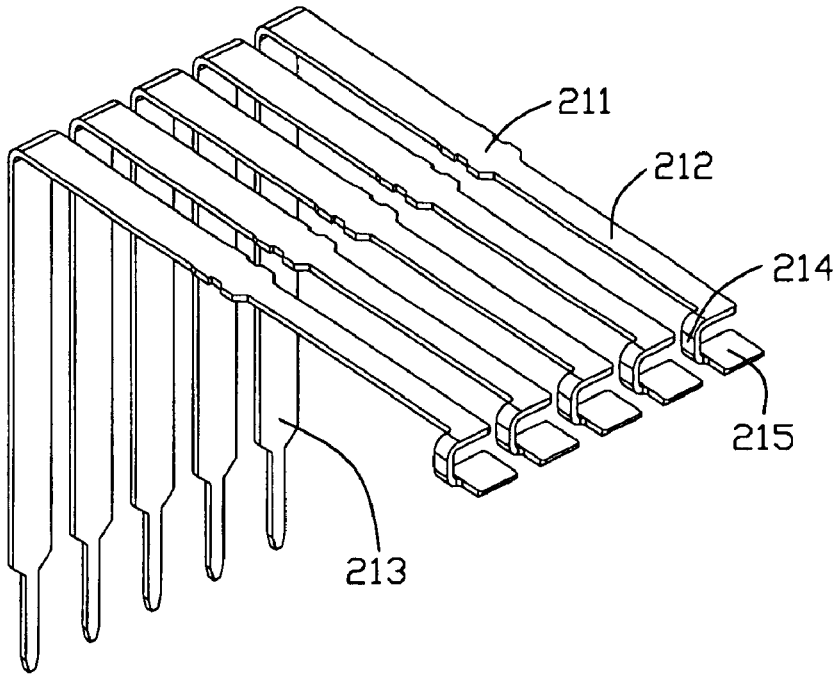
FIG. 3 is a perspective view of the upper contacts shown in FIG. 1.

Referring to FIGS. 2 and 3, each group of electrical contacts 20 includes a row of upper contacts 21 and a row of lower contacts 22. Each lower contact 22 includes a retention section 221 engaging with the isulative housing 10. A elastic contact section 222 extends from one end of the retention section 221 in a direction generally parallel to the tongues 14, 15 and has a convex bend 223 mating with a complementary contact (not shown) of the mating plug 200. The contacts sections 222 are received in the lower recesses 142 of the insulative housing 10. The lower contacts 22 also include a mounting section 224 extending from the other end of the retention section 221 for mounting to the PCB.

Each upper contacts 21 also includes a retention section 211 engaging with the insulative housing 10, an extending section 212 extending from one end of the retention section 211, and a mounting section 213 from the other end of the retention section 211. The extending section 212 is parallel to the tongue 14, 15 and received in the upper recess 141. A connect section 214 is bending from a side edge of the extending section 212 at the front end thereof and perpendicular to the front face 145. A flat non-elastic contact section 215 is connected with the connect section 214 and parallel to the extending section 212. The contact sections 215 and the connect sections 214 are received in the notches 146 and the passageways 147, respectively.

As illustrated in FIGS. 1 and 5, the contact sections 215, 222 of the upper contacts 21 and the lower contacts 22 are located on the lower side of the tongue 14, 15 and staggered along the mating direction of the electrical connector 100. The contact sections 215 of the upper contacts 21 are close to the front face 145 than the contact sections 222 of the lower contacts 22. The contact points, namely the contact sections 215 and the convex bends 223 of the upper contacts 21 and the lower contacts 22 also staggered along the vertical direction so that to mating with the corresponding contacts (not labeled) of the plug 200 at different height.

The extending section 212 and the contacts section 215 are connected by the connect section 214 at the side edge thereof so that a front end of the upper contact 21 is located in the interior of the tongue 14, 15. Therefore, an intervening spacing is generated between the front face 145 and the front ends of the upper contacts 21 to prevent the upper contacts 21 contacting with the shell 40 of the plug 200 and avoid the ESD problem to the upper contacts 21.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector for mating with a complementary plug, comprising:

an insulative housing having a rear section and a tongue with a front face for mating with the plug, the tongue comprising a first side and a second side perpendicular to the front face;

a plurality of electrical contacts attached to the insulative housing including a row of first contacts and a row of second contacts, the second contacts being arranged on the first side of the tongue, the first contacts including a first part and a second part to be arranged on the first and second sides of the tongue respectively, and wherein the first part and second part of the first contact are connected with a connect part at a front end thereof and close to the front face of the tongue, and wherein the connect part is perpendicular to the front face of the tongue.

2. The electrical connector as claimed in claim 1, wherein the first part of the first contact is a contact section for contacting with the mating plug.

3. The electrical connector as claimed in claim 2, wherein the second parts of the first contacts each comprises a retention section engaging with the insulative housing and an extending portion extending from the retention section and parallel to the tongue.

4. The electrical connector as claimed in claim 3, wherein the contact sections and the extending sections of the first contacts are separating from the front face of the tongue with an intervening space.

5. The electrical connector as claimed in claim 1, wherein each second contact includes a retention section engaging with the insulative housing, a mounting section connect with one end of the retention portion, and a contact section connected with the other end of the retention section.

6. The electrical connector as claimed in claim 1, wherein the first contacts and the second contacts each comprises a contact point for contacting with the plug, and wherein the contact points of the first contacts and the second contacts are arranged at different height.

7. The electrical connector as claimed in claim 6, wherein the contact points of the first contacts and the second contacts are arranged on the first side of the tongue and staggered along a mating direction of the electrical connector.

8. The electrical connector as claimed in claim 6, wherein the contact points of the second contacts are elastic and the contact points of the first contacts are non-elastic.

9. An electrical connector for mating with a complementary plug, comprising:

an insulative housing having a rear section and a tongue extending from the rear section, the tongue defining a front face at a front end thereof, the tongue also comprising a upper side and a lower side perpendicular to the front face; and electrical contacts attached to the insulative housing including a plurality of upper contacts and a plurality of lower contacts, the lower contacts being arranged on the lower side of the tongue and each including a contact section for contact with the plug, the upper contacts each including an extending section arranged on the upper side of the tongue and a contact section bent from a side edge of the extending section of the upper contact and extending through a passageway of the tongue, and wherein the contact sections of the upper contacts are arrange on the lower side of the tongue.

10. The electrical connector as claimed in claim 9, wherein the passageways of the tongue are perpendicular to the front face and located at the front end of the tongue.

11. The electrical connector as claimed in claim 9, wherein the contact sections of the upper contacts and the lower contacts are staggered along a mating direction of the electrical connector.

12. The electrical connector as claimed in claim 11, wherein the contact sections of the upper contact is close to the front face of the tongue than the contact sections of the lower contacts.

13. The electrical connector as claimed in claim 9, wherein the contact sections of the lower contacts are elastic and the contact sections of the upper contacts are non-elastic.

14. The electrical connector as claimed in claim 9, wherein the tongue defines two rows of recesses at the upper and lower sides thereof, and wherein the upper and lower contacts are received in the two rows of recesses respectively.

15. The electrical connector as claimed in claim 9, further comprising an outer shield generally surrounding the housing and having grounding contacts to create an electrical connection between the conductive outer shield and the plug.

* * * * *